US008807909B2

(12) United States Patent
Tracy et al.

(10) Patent No.: US 8,807,909 B2
(45) Date of Patent: Aug. 19, 2014

(54) TILTING SYSTEM FOR LOADER MACHINE

(71) Applicant: Caterpillar Inc., Peoria, IL (US)

(72) Inventors: William C. Tracy, Raleigh, NC (US); Karl Canner, Derbyshire (GB); Wayne E. Harshberger, II, Oswego, IL (US); Jason J. Hagedorn, Singapore (SG); Darren M. Schambach, Oswego, IL (US); James White, Leicestershire (GB)

(73) Assignee: Caterpillar Inc., Peoria, IL (US)

( * ) Notice: Subject to any disclaimer, the term of this patent is extended or adjusted under 35 U.S.C. 154(b) by 123 days.

(21) Appl. No.: 13/650,471

(22) Filed: Oct. 12, 2012

(65) Prior Publication Data

US 2014/0105715 A1 Apr. 17, 2014

(51) Int. Cl.

| | |
|---|---|
| ***E02F 3/34*** | (2006.01) |
| ***E02F 9/00*** | (2006.01) |
| ***E02F 3/43*** | (2006.01) |

(52) U.S. Cl.

CPC ..... *E02F 3/3411* (2013.01); *E02F 9/006* (2013.01); *E02F 3/43* (2013.01)

USPC ..... 414/697; 37/442

(58) Field of Classification Search

CPC . E02F 9/006; E02F 3/43–3/434; E02F 3/3411

USPC ..... 414/697; 37/442

See application file for complete search history.

(56) References Cited

U.S. PATENT DOCUMENTS

| | | | | |
|---|---|---|---|---|
| 2,965,253 | A * | 12/1960 | Poulter et al. | 414/694 |
| 3,148,791 | A * | 9/1964 | Kampert et al. | 414/707 |
| 3,918,601 | A * | 11/1975 | Zimmerman | 414/697 |
| 4,054,216 | A * | 10/1977 | Inui et al. | 414/697 |
| 5,405,237 | A | 4/1995 | Oka | |
| 5,592,762 | A | 1/1997 | Hendron | |
| 2012/0128456 | A1 * | 5/2012 | Grimes et al. | 414/715 |

FOREIGN PATENT DOCUMENTS

JP 59015134 A * 1/1984

* cited by examiner

*Primary Examiner* — Gerald McClain
(74) *Attorney, Agent, or Firm* — Bart A. Fisher

(57) ABSTRACT

A tilting system for an implement pivotally connected to a lift arm. The tilting system includes a tilt cylinder configured to provide a rotary movement to the implement. The tilting system includes a tilt lever pivotally connected to the tilt cylinder by a pivot pin E and to the implement by a pivot pin C. The tilting system further includes a tilt link pivotally connected to a lift arm by a pivot pin F, and to the tilt lever by a pivot pin D. An angle defined between a line DE connecting the pivot pins D and E and a line DC connecting the pivot pins D and C, is in the range of 135 to 165 degrees.

20 Claims, 7 Drawing Sheets

TILTING SYSTEM FOR LOADER MACHINE

TECHNICAL FIELD

The present disclosure relates to loader machines and, in particular to improvements in design of a tilting system in such machines.

BACKGROUND

Loader machines are used for moving material from one place to another. These machines include a linkage assembly for manipulating an implement to perform such operation. The linkage assembly includes a pair of lift arms coupled to an end frame. The lift arm may be generally raised or lowered by corresponding lift cylinders to adjust the elevation of the implement above the ground. Further, the tilt of the implement (rotation of the implement about a pivot connection at the end of the lift arms) is controlled by a tilting system having a tilt lever and tilt link coupled between the lift arms and the implement and operated by a tilt cylinder.

The lift arms may have to traverse a range of motion to move the materials, and so the implement connected to the lift arms may also tilt. If the implement is a bucket, it may be desired that the bucket is positioned at a bucket angle that provides adequate material retention throughout the range of motion of the lift arm. Therefore, a need exists for an improved tilting system design which primarily helps to achieve this with minimal changes in the overall design of the linkage assembly.

SUMMARY

The present disclosure provides a tilting system for an implement pivotally connected to a lift arm. The tilting system includes a tilt cylinder configured to provide a rotary movement to the implement. The tilting system includes a tilt lever having a first end and a second end, where the first end is pivotally connected to the tilt cylinder by a pivot pin E and the second end is pivotally connected to an implement by a pivot pin C. The tilting system further includes a tilt link having a first end and a second end, where the first end is pivotally connected to a lift arm by a pivot pin F, and the second end is pivotally connected between the first and second ends of the tilt lever by a pivot pin D. An angle defined between a line DE connecting the pivot pins D and E and a line DC connecting the pivot pins D and C, is in the range of 135 to 165 degrees.

Other features and aspects of this disclosure will be apparent from the following description and the accompanying drawings.

DETAILED DESCRIPTION

Figure 1:
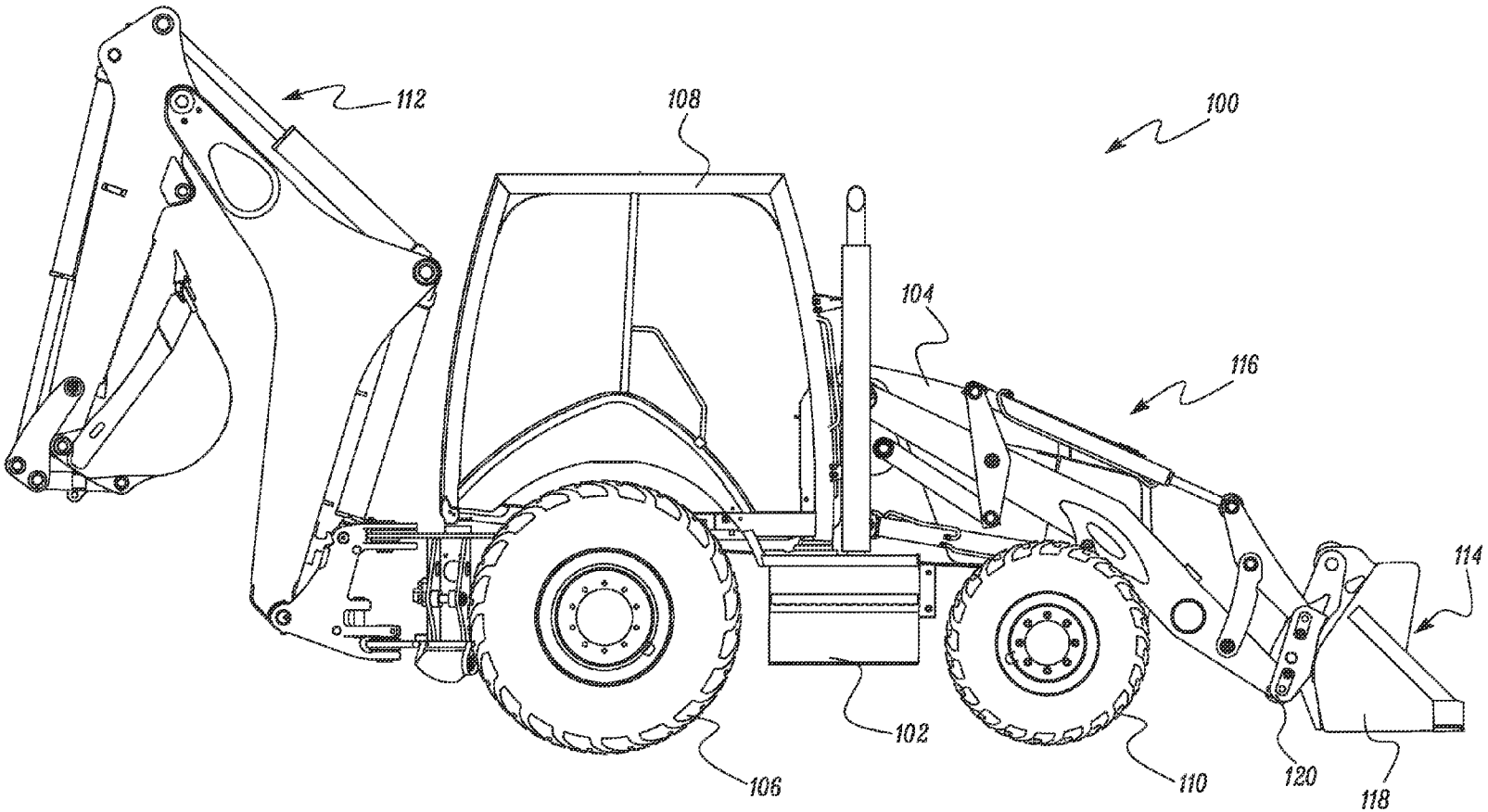
FIG. 1 illustrates a pictorial representation of an exemplary disclosed loader machine.

FIG. 1 illustrates a loader machine 100 in accordance with an embodiment of the present disclosure. It is contemplated that the described embodiments may be implemented in any machine such as a backhoe loader, a front wheel loader, a dozer, an excavator, a harvester or any other machine. As illustrated, the loader machine 100 may include a body portion 102 and an end frame 104 connected to the body portion 102. The body portion 102 is configured to house an engine that may drive a pair of driving wheels 106 by a suitable mechanical or electrical transmission. The body portion 102 may also support an elevated cab 108 for an operator. As illustrated, the end frame 104 may include a pair of steering wheels 110 that are configured to be maneuvered by a steering mechanism associated with the loader machine 100. In an embodiment, the loader machine 100 may also include a backhoe assembly 112, as illustrated in FIG. 1.

The loader machine 100 further includes an implement 114 that may be moved and/or tilted in order to perform an earth moving operation. In the illustrated embodiment, the implement 114 is embodied as a bucket to scoop, lift, and dump a variety of materials. As illustrated in FIG. 1, the implement 114 may be connected to the end frame 104 by a linkage assembly 116. The linkage assembly 116 may be configured to securely attach the implement 114 during the operation of the loader machine 100, and to release and/or exchange the implement 114, if required.

Herein, the implement 114 and the linkage assembly 116 are illustrated and described as being separate connectable components. Those skilled in the art will understand that the implement 114, including, but not limited to, buckets and pallet forks, may be configured as a unitary component having a material handling portion 118 and a coupler 120 with means of attaching the implement 114 with the linkage assembly 116.

Figure 2:
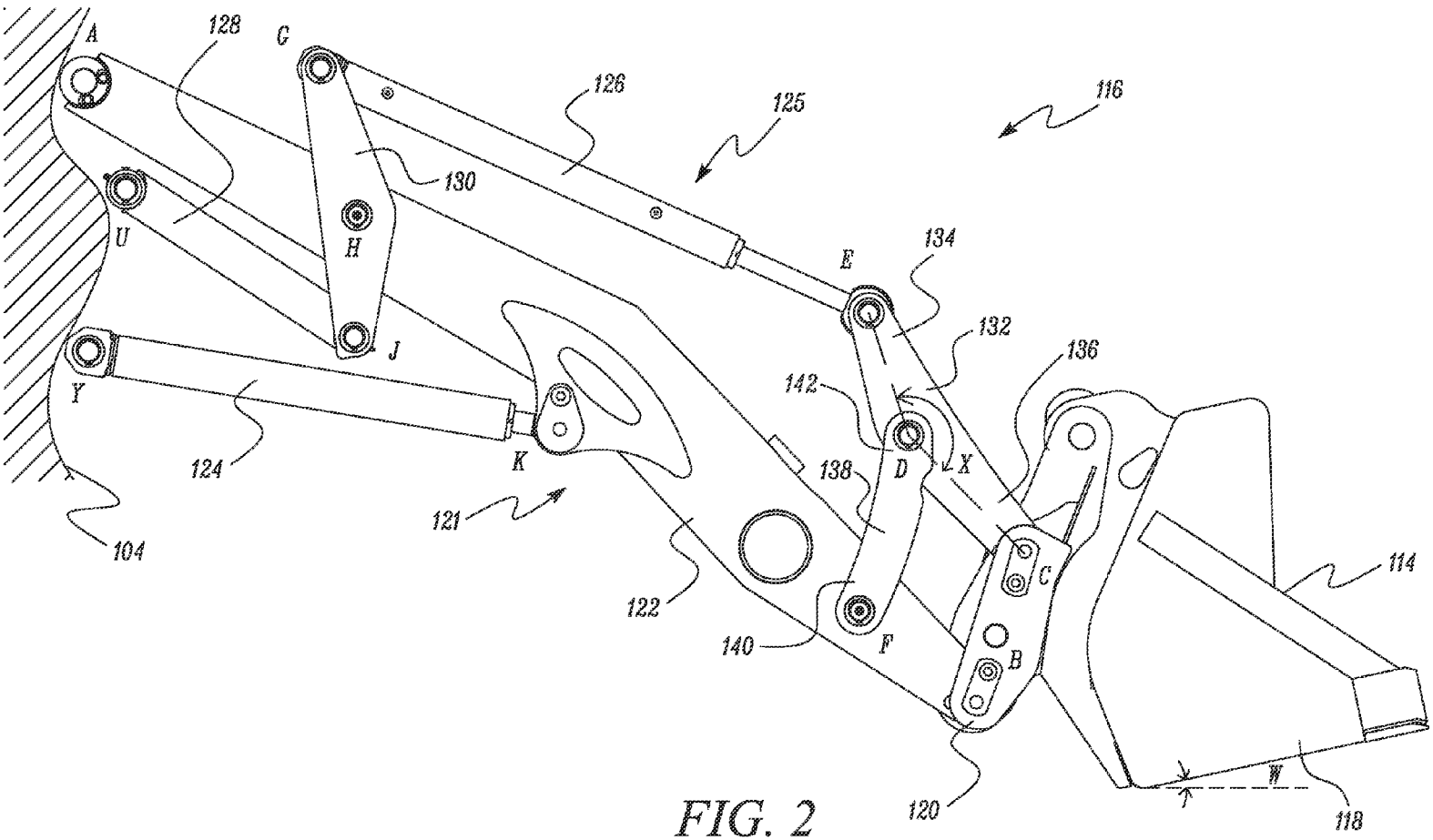
FIG. 2 illustrates a side view of a linkage assembly, in accordance with an aspect of the present disclosure.
Figure 3:
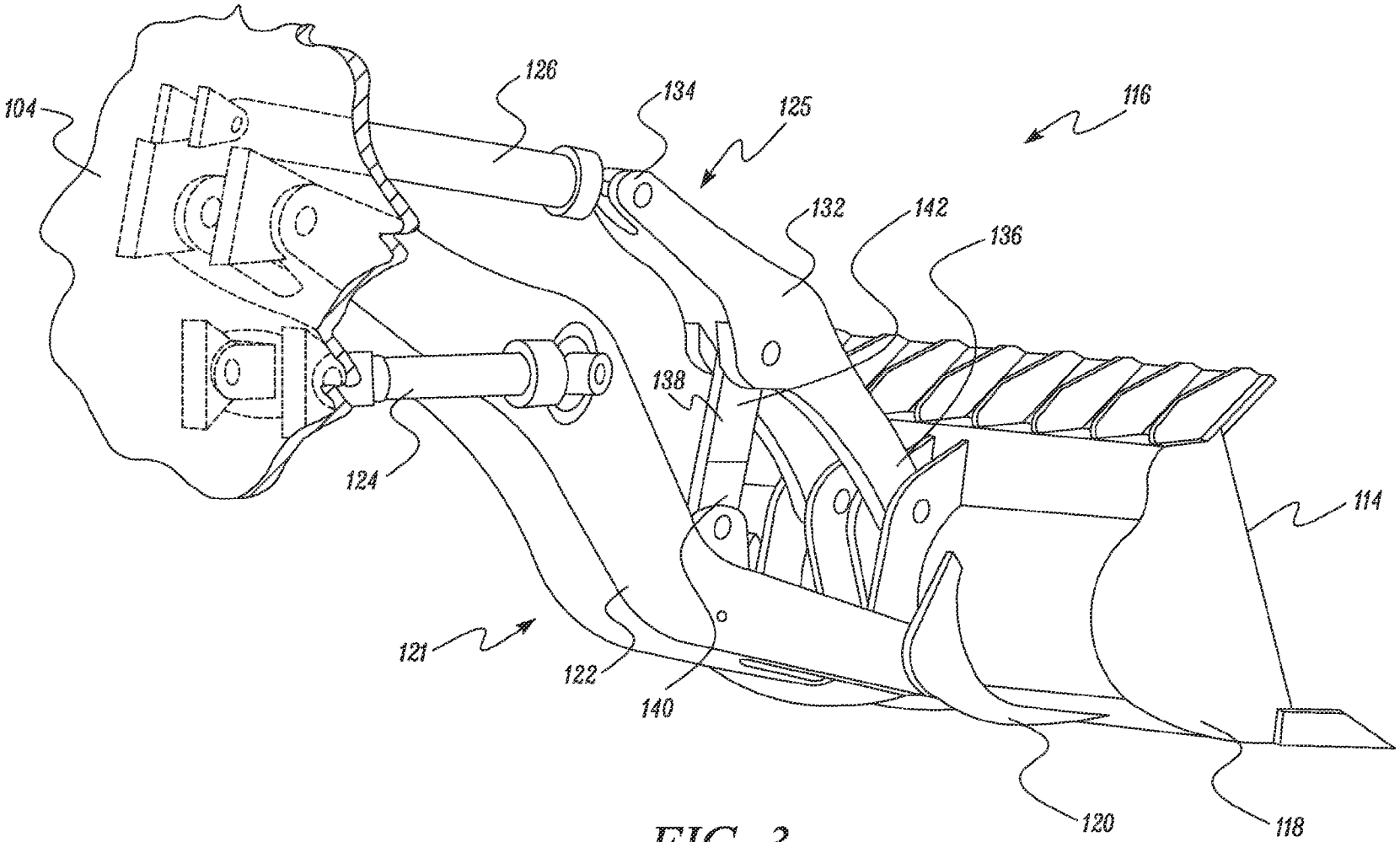
FIG. 3 illustrates a perspective view of a linkage assembly, in accordance with another aspect of the present disclosure.

The kinematic arrangement of various elements in the linkage assembly 116 may control the movement of the implement 114 has been illustrated in FIGS. 2 and 3. FIG. 2 illustrates a plurality of connections, made by pivot pins about which various kinematic elements of the linkage assembly 116 may rotate, with respect to one another, in accordance with an embodiment of the present disclosure. Further, FIG. 3 illustrates a perspective view of another linkage assembly 116 utilized in a front wheel loader embodied as the loader machine 100. It should be noted that FIGS. 2 and 3 illustrate different kinematic arrangements for the linkage assembly 116, however both may benefit from the present disclosure. For the purpose of the present disclosure, the following description is based on the exemplary embodiment illustrated in FIG. 2. Furthermore, in the following discussion, the connection will be designated by their respective pivot pins reference.

In an embodiment, the linkage assembly 116 includes a lifting arrangement 121 for controlling the lift movement of the implement 114. The lifting arrangement 121 includes a lift arm 122 connected from one end to the end frame 104 by means of pivot pins A, and from the other end to the coupler 120 associated with the implement 114, proximate to the bottom of the implement 114, by means of pivot pins B.

Further, the lifting arrangement 121 includes a lift cylinder 124 which may be connected to the end frame 104 at a cylinder end by pivot pins Y, and to the lift arm 122 at a rod end by pivot pins K.

In typical implementations, two lift arms 122 may be provided, with each having the corresponding lift cylinders 124. However, a single lift arm 122 and lift cylinder 124, two lift arms 122 driven by a single lift cylinder 124, or other arrangements of the lift arms 122 and the lift cylinders 124 providing similar functionality may be implemented, and are contemplated as having use in the loader machine 100, in accordance with the present disclosure. The lift arm 122 may rotate about the point of connection at pivot pins A, wherein the rotation of the lift arm 122 being controlled by the lift cylinder 124. The lift cylinder 124 may be extended to raise the lift arm 122 and retracted to lower the lift arm 122.

According to an embodiment of the present disclosure, a rotation of the implement 114 is controlled by a tilting system 125, in the linkage assembly 116. The tilting system 125 may include a tilt cylinder 126 to provide an actuation force for the rotary/tilt movement of the implement 114. A person having ordinary skill in the art may understand that, the lift cylinder 124 and the tilt cylinder 126 are hydraulic cylinders driven by a pump or a some means using a pressurized hydraulic fluid, or alternatively may be some other kind of actuators such as a pneumatic linear actuators, piezoelectric actuators, electromechanical actuators, or the like.

In an embodiment, the tilt cylinder 126, in the tilting system 125, may be supported on the end frame 104 by means of a rear tilt link 128 and a rear tilt lever 130. The rear tilt link 128 may be connected to the end frame 104 by pivot pins U. The rear tilt lever 130 may be connected to the rear tilt link 128 by pivot pins J and to the tilt cylinder 126 by pivot pins G. Further, the rear tilt lever 130 may be pivotally connected to the lift arm 122 at a point between the connection points J and G by pivot pins H, with the same being the rotational axis of the rear tilt lever 130. Alternatively, the tilt cylinder 126 may be connected directly to the end frame 104 at the cylinder end by means of a pivot connection, as illustrated in the embodiment shown in FIG. 3. For a given position of the lift arm 122, the implement 114 may be rotated toward the racked position by retracting the tilt cylinder 126, and rotated in the opposite direction toward the dump position by extending the tilt cylinder 126, in the tilting system 125.

The tilting system 125 may further include a tilt lever 132 having a first end 134 and a second end 136. The tilt lever 132 may be connected to a rod end of the tilt cylinder 126 at the first end 134 by pivot pins E, and to the coupler 120 of the implement 114 at the second end 136 by pivot pins C. Further, the tilting system 125 may include a tilt link 138 having a first end 140 and a second end 142. The tilt link 138 may be connected to the lift arm 122 at the first end 140 by pivot pins F; and to the tilt lever 132 at the second end 142 by pivot pins D, between the points E and C.

The performance of the loader machine 100 may be affected by the arrangement of the various kinematic elements in the linkage assembly 116. For example, in one embodiment, the improved performance may be achieved through a combination of increasing the length of the various kinematic elements and/or moving the location of the pivot pins, such as C, in relation to other pivot pins, such as E and D, connecting the various kinematic elements.

According to an embodiment, an angle X defined between a line DE connecting the connection points D and E and a line DC connecting the connection points D and C may be in a pre-determined range of about 135 to 165 degrees. The loader machines 100 in accordance with the present disclosure, with the tilting system 125 having the angle X (angle E-D-C) in the pre-determined range may provide improved performance. This improved performance may be best illustrated by comparing various values of the angles X in the tilting system 125 in the disclosed embodiment herein to those of previously known linkage assemblies. From hereon, the benefits of the tilting system 125 with respect to the angle X in the pre-determined range are described by using a bucket as the implement 114.

The material retention capability for a loader machine with the implement 114, embodied as a bucket, primarily depends on a bucket angle W. As illustrated in FIG. 2, the bucket angle W is defined between a base plane of the implement 114 and a horizontal axis. A bucket angle W approximately 55 degrees provides better material retention. However, due to limitations inherent in the linkage assemblies, such as, interference between the various kinematic elements, the optimal bucket angle W may not be achievable through the entire range of motion of the lift arm 122. Therefore, a tilting system 125 which helps to keep the bucket angle W near to optimal value, for a range of motion of the lift arm 122, may be best suited for the loader machine 100.

Figure 4:
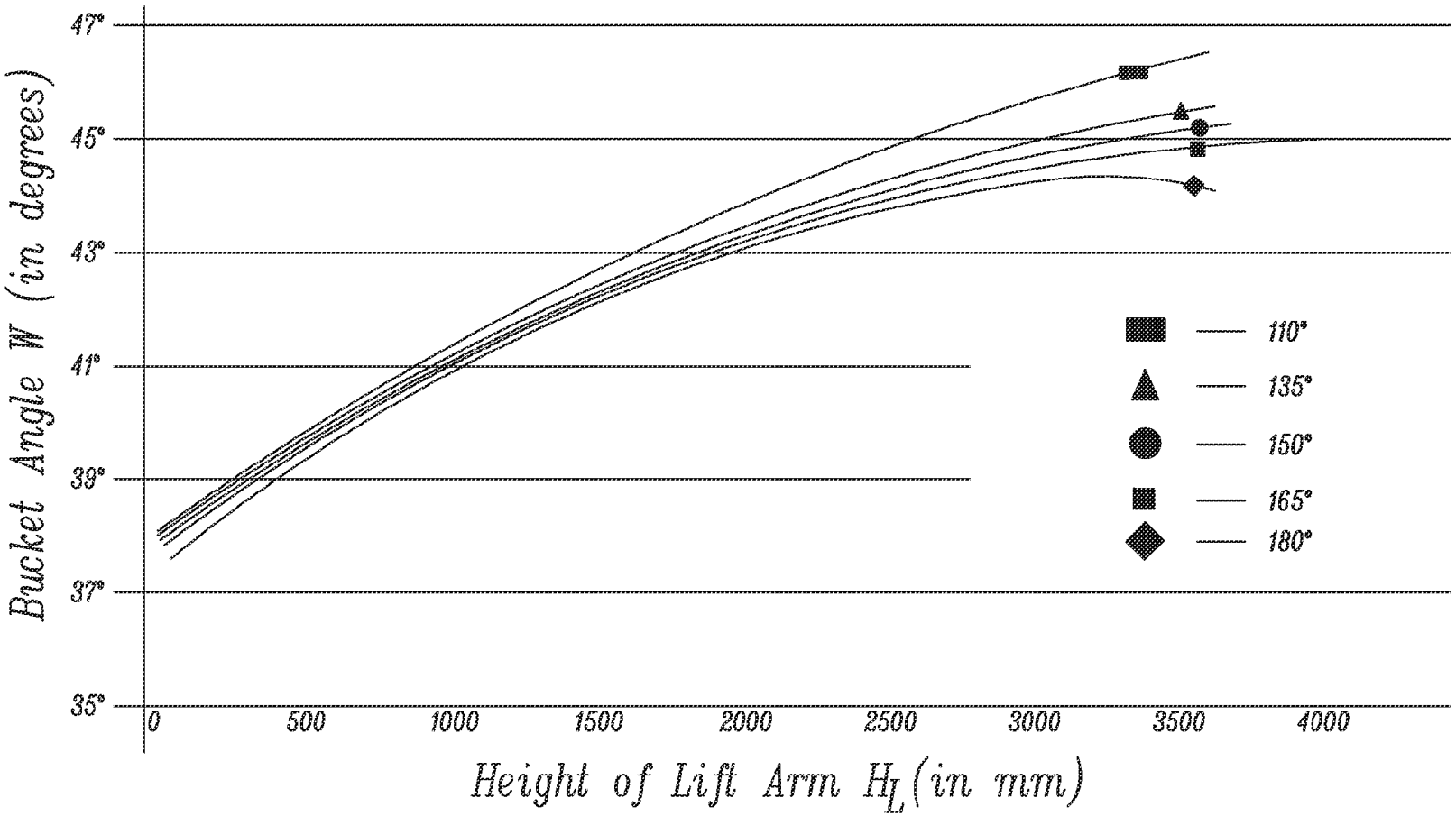
FIG. 4 illustrates a plot showing the variation of a bucket angle with respect to a height of a lift arm for the linkage assembly, in accordance with an aspect of the present disclosure.

Referring now to FIGS. 4-7, the tilting system 125 of the present disclosure with the angle X in the pre-determined range of 135-165 degrees provides an improved material retention capability for the loader machine 100. FIG. 4 illustrates a plot showing the bucket angle W (in degrees) with respect a height of the lift arm $H_L$ (in mm) for various angles X in the tilting system 125. The plot for each value of angle X has been distinguished by different symbols placed over. As seen in FIG. 4, as the angle X approaches within the pre-determined range of 135-165 degrees, the bucket angle W shifts automatically closer to the optimum angle of 55 degrees (constrained by the rest of the linkage assembly), as compared to the angles X outside the pre-determined range 135-165 degrees.

Figure 5:
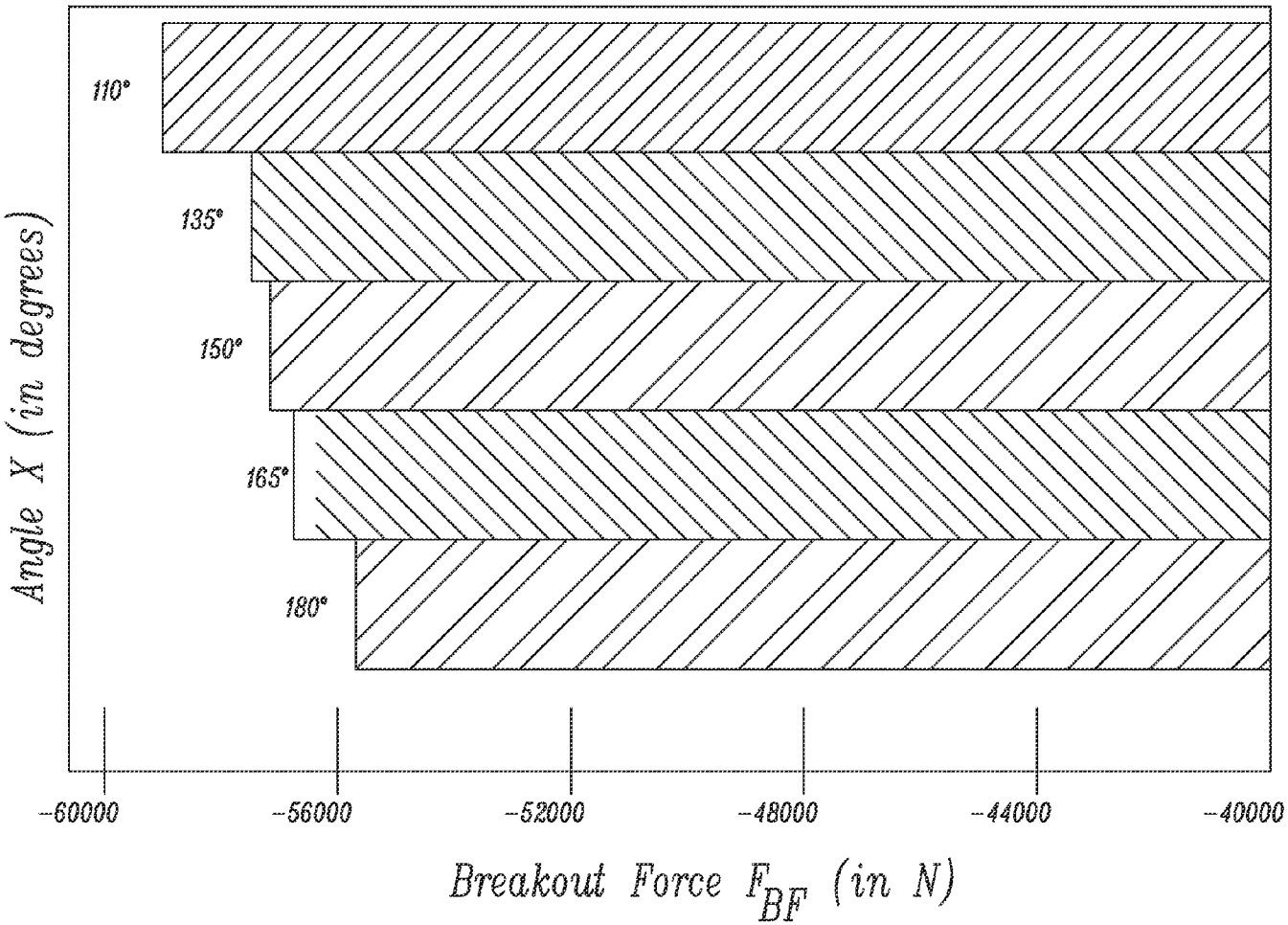
FIG. 5 illustrates a graph showing breakout force generated for the linkage assembly, in accordance with an aspect of the present disclosure.

Further, in the tilting system 125 of the present disclosure with the angle X in the pre-determined range generates more breakout force $F_{BF}$ in N, that is, the available force for the loader bucket to "break out" of the material being lifted from an original position. FIG. 5 illustrates a graph plot of the breakout force $F_{BF}$ generated for various angles X. As shown in FIG. 5, the angle X between 135-165 degrees generates more breakout force $F_{BF}$ in the linkage assembly 116 configuration for the loader machine 100. As illustrated, outside the pre-determined range 135-165 degrees for angle X, the breakout force $F_{BF}$ may not significantly increases in case the angle X goes beyond above 165 degrees and correspondingly also decrease significantly for the angle X below 135 degrees.

Figure 6:
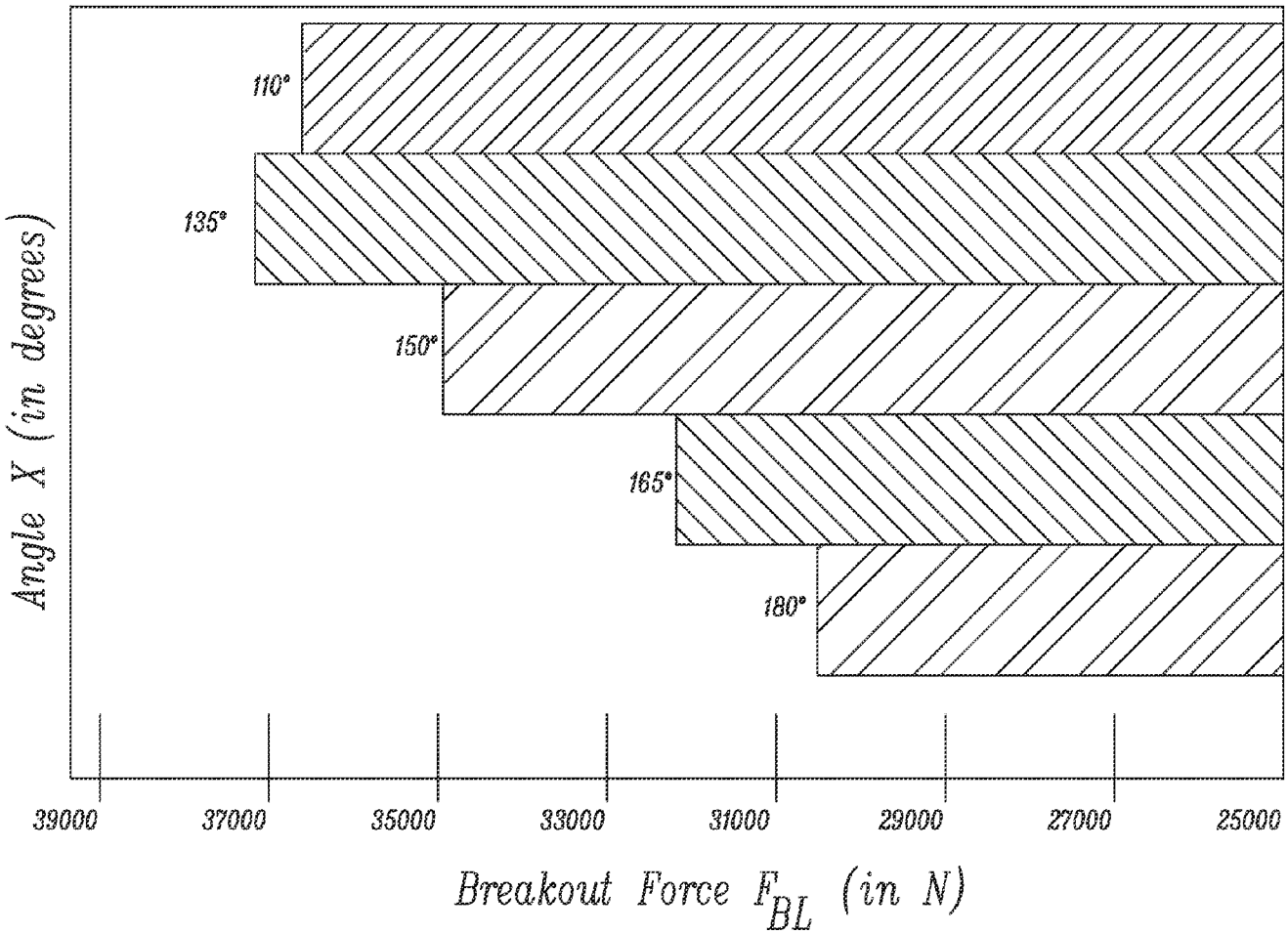
FIG. 6 illustrates a graph showing bulldoze force generated for the linkage assembly, in accordance with an aspect of the present disclosure.

Further, FIG. 6 illustrates a graph plot of a bulldoze force $F_{BL}$ in N generated for various angles X. The bulldoze force $F_{BL}$ may be a measure of a force with which the loader machine 100 may force out in order to level a surface. As shown in FIG. 6, the bulldoze force $F_{BL}$ may be maximum for in the pre-determined angle X at 135 degrees, and it decreases outside the pre-determined range of 135-165 degrees.

Figure 7:
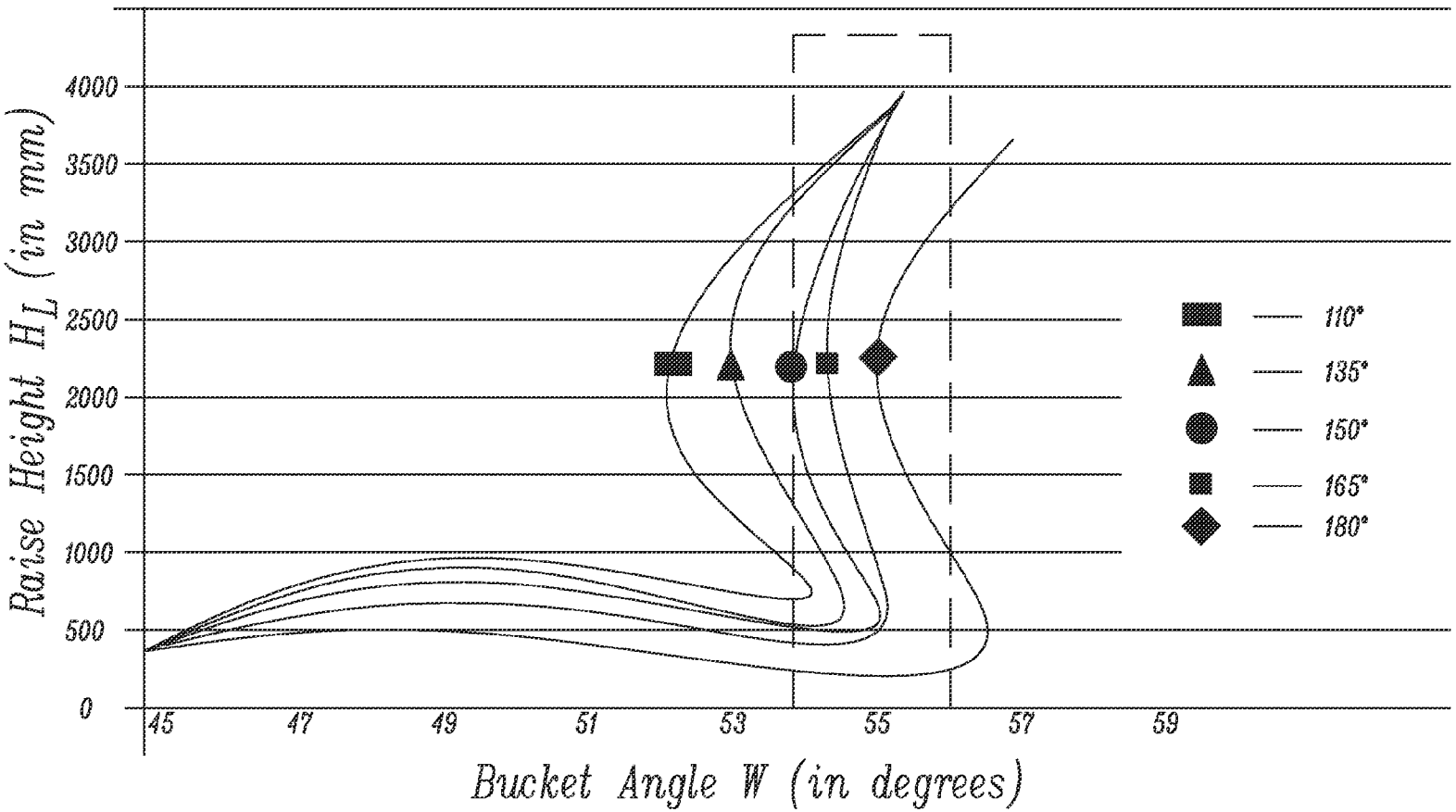
FIG. 7 illustrates a graph plot of the bucket angle with respect to a raise height of a lift arm, in accordance with an aspect of the present disclosure.

Furthermore, FIG. 7 illustrates a graph plot of the bucket angle W with respect to a raise height $H_B$ of the lift arm 122 for various angles X. In the exemplary embodiment, the raise height $H_B$ may be the height of the pivot pin B (see FIG. 2) from the ground level, when the implement 114 is in the racked position and stops resting on a provided mechanical stop and starts resting on the minimum cylinder extension, for example of the lift cylinder 124. As illustrated, between the pre-determined range of angle X the raise height $H_B$ falls close to the bucket angle W about 55 degrees, whereas for angles X below 135 degrees and the above 165 degrees the raise height $H_B$ falls outside the bucket a range of about bucket angle 55 degrees, which can lead to material spillage during lifting.

Referring now to Table 1 (below) shows the deviation in some of the tilt cylinder 126 characteristics in relation to the angle X. For this purpose, Table 1 lists a range of angles X in first column for a reference tilting system against the tilt cylinder characteristics, like cylinder stroke (in mm) and dead length (in mm). It may be noted that if a hydraulic cylinder is designed with more dead length (the excess material length not included in the pin-to-pin distance), the hydraulic cylinder manufacturer will be able to build the cylinder with lighter tolerances and thus with more cost effectiveness. Further, the larger stroke length for a given hydraulic cylinder may be preferred in most circumstances.

TABLE 1

Angle X vs. Tilt Cylinder Characteristics

| Angle X | Cylinder Stroke (in mm) | Dead Length (in mm) |
|---|---|---|
| 180° | 786.4 | 109.3 |
| 171° | 788.7 | 214.6 |
| 157° | 790.5 | 320.7 |
| 135° | 792.0 | 427.3 |

Further, the total length of the EDC link has to become longer to provide the same performance if the angle is closer to 180 degrees. It may be contemplated that more length for the link EDC means that more material will go into the design and thus it will cost more to produce. Table 2 below, lists the angle X in column 1 against the required length of link EDC and further shows the percentage decrease of the length, and proportionally the material required, with the change in the angle X. It may be understood from the Table 2, as the angle X approaches the pre-determined range of 135-165 degrees, the required length of the link EDC decreases, and consequently the material required and effective cost to manufacture.

TABLE 2

| Angle X | Link EDC Length (in mm) | Percentage Decrease |
|---|---|---|
| 180° | 850 | 0 |
| 171° | 761 | −10.47% |
| 157° | 687 | −29.30% |
| 135° | 640 | −32.81% |

INDUSTRIAL APPLICABILITY

The industrial applicability of the apparatus described herein will be readily appreciated from the foregoing discussion. The loader machine 100 in accordance with the present disclosure provide improved performance, particularly, for the bucket as the implement 114; and also acceptable to good performance for the pallet fork as the implement 114. The performance is achieved with the tilting system 125 with the angle X in the pre-determined range that have not been known in previous loader machines implementing a linkage assembly with a similar arrangement of the various kinematic elements therein.

The performance improvements of a loader machine with the bucket, as the implement 114, may be considered by the ability of the implement 114 to scoop an optimal amount of loose material from a pile and transport the material in a stable manner without much spilling. In this respect, the breakout force generated and change in the bucket angle W over the range of motion of the lift arm 122, in the linkage assembly 116, may play a significant role. As may be understood by the accompanied plots (FIGS. 4-7) and tables (Table 1 and 2), the pre-determined range of 135-165 degrees for the angle X may help to achieve near optimum value for these factors to produce improved results and performance for the loader machine 100, in general.

Specifically, as illustrated in FIG. 4, the tilting system 125 with the angle X in the pre-determined range helps to achieve the optimal bucket angle W over the range of the motion of the lift arm 122 shown in terms of its height $H_L$ above the ground. It may be seen that the graph line showing the variation in the bucket angle W over the height $H_L$ of the lift arm 122 above the ground for the angle X equals 135 degrees has the bucket angle W closer to the optimal bucket angle for most part of the motion of the lift arm 122 as compared to the other exemplary angles.

FIG. 5 illustrates the effect of the change in the angle X over the breakout force generated in the linkage assembly 116. As the graph suggests, as the angle X approaches 180 degrees, which is typical with the conventional linkages, the generated breakout force is more towards the lower side of the force axis. Further, it may be seen, in one embodiment, that the maximum breakout force generated, that is, approximately −54000.0 N (it may be noted that more the negative force, the better) is achieved when the angle X is getting closer to 135 degrees. Therefore, the tilting system 125 of the present disclosure further helps to provide more breakout force and thus the improved performance in this respect as well.

Further, to be noted as have been confirmed by various conducted tests that the described design of the tilting system 125 also leads to many other advantages for the linkage assembly 116 and thus the loader machine 100, in general. For example, this design helps to provide improved transmission angles, increased velocity during operation of the implement 114. Also, such design have helped to achieve better lift height for the lift arm 116, reduced pin loads in the linkage assembly 116, and result in better aesthetic and visibility constraints.

Although the embodiments of this disclosure as described herein may be incorporated without departing from the scope of the following claims, it will be apparent to a person skilled in the art that various modifications and variations to the above disclosure may be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A tilting system for an implement pivotally connected to a lift arm, the tilting system comprising:

a tilt cylinder configured to provide rotary movement to the implement;

a tilt lever having a first end and a second end, the first end being pivotally connected to the tilt cylinder by a pivot pin E and the second end being pivotally connected to the implement by a pivot pin C;

a tilt link having a first end and a second end, the first end being pivotally connected to the lift arm by a pivot pin F, and the second end being pivotally connected between the first and second ends of the tilt lever by a pivot pin D; and wherein a rigid angle defined between a line DE connecting the pivot pins D and E and a line DC connecting the pivot pins D and C, is in the range of 135 to 165 degrees.

2. The tilting system of claim 1, wherein the angle defined between the line DE and the line DC is 135 degrees.

3. The tilting system of claim 1, wherein the angle defined between the line DE and the line DC is 165 degrees.

4. The tilting system of claim 1 further including a rear tilt link and a rear tilt lever to support the tilt cylinder on an end frame.

5. The tilting system of claim 4, wherein the rear tilt link is pivotally supported on the end frame by a pivot pin U.

6. The tilting system of claim 4, wherein the rear tilt lever is pivotally connected to the rear tilt link by a pivot pin J, and to the tilt cylinder by a pivot pin G.

7. The tilting system of claim 4, wherein the rear tilt lever is pivotally connected to the lift arm by a pivot pin H.

8. A linkage assembly configured to support and provide movement to an implement, the linkage assembly comprising:

a lifting arrangement including:

a lift arm pivotally connected to the implement by a pivot pin B;

a lift cylinder pivotally connected to the lift arm by a pivot pin K, the lift cylinder configured to provide a lift movement to the implement;

a tilting system including:

a tilt cylinder configured to provide a rotary movement to the implement;

a tilt lever having a first end and a second end, the first end being pivotally connected to the tilt cylinder by a pivot pin E and the second end being pivotally connected to the implement by a pivot pin C;

a tilt link having a first end and a second end, the first end being pivotally connected to the lift arm by a pivot pin F, and the second end being pivotally connected between the first and second ends of the tilt lever by a pivot pin D; and wherein a rigid angle defined between a line DE connecting the pivot pins D and E and a line DC connecting the pivot pins D and C, is in the range of 135 to 165 degrees.

9. The linkage assembly of claim 8, wherein the angle defined between the line DE and the line DC is 135 degrees.

10. The linkage assembly of claim 8, wherein the angle defined between the line DE and the line DC is 165 degrees.

11. The linkage assembly of claim 8, wherein the lift arm is pivotally supported on an end frame by a pivot pin A.

12. The linkage assembly of claim 8 further including a rear tilt link and a rear tilt lever to support the tilt cylinder on an end frame.

13. The linkage assembly of claim 12, wherein the rear tilt link is pivotally supported on the end frame by a pivot pin U.

14. The linkage assembly of claim 12, wherein the rear tilt lever is pivotally connected to the rear tilt link by a pivot pin J, and to the tilt cylinder by a pivot pin G.

15. The linkage assembly of claim 10, wherein the rear tilt lever is pivotally connected to the lift arm by a pivot pin H.

16. A loader machine, comprising:

an end frame;

an implement configured to perform an earth moving operation;

a lift arm pivotally supported on the end frame by a pivot pin A and pivotally supporting the implement by a pivot pin B;

a lift cylinder pivotally connected to the lift arm by a pivot pin K, the lift cylinder configured to provide a lift movement to the implement;

a tilt cylinder configured to provide a rotary movement to the implement;

a tilt lever having a first end and a second end, the first end being pivotally connected to the tilt cylinder by a pivot pin E and the second end being pivotally connected to the implement by a pivot pin C;

a tilt link having a first end and a second end, the first end being pivotally connected to the lift arm by a pivot pin F, and the second end being pivotally connected between the first and second ends of the tilt lever by a pivot pin D; and wherein a rigid angle defined between a line DE connecting the pivot pins D and E and a line DC connecting the pivot pins D and C, is in the range of 135 to 165 degrees.

17. The loader machine of claim 16, wherein the angle defined between the line DE and the line DC is 135 degrees.

18. The loader machine of claim 16 further including a rear tilt link and a rear tilt lever to support the tilt cylinder on the end frame.

19. The loader machine of claim 16, wherein the rear tilt link is pivotally supported on the end frame by a pivot pin U.

20. The loader machine of claim 16, wherein the rear tilt lever is pivotally connected to the rear tilt link by a pivot pin J, to the tilt cylinder by a pivot pin G, and to the lift arm by a pivot pin H.

* * * * *